US010018421B2

(12) United States Patent
Tseng

(10) Patent No.: US 10,018,421 B2
(45) Date of Patent: Jul. 10, 2018

(54) CONTINUOUS FURNACE SYSTEM HAVING HEAT RECYCLING DEVICE

(71) Applicant: King Yuan Dar Metal Enterprise Co., Ltd., Changhua (TW)

(72) Inventor: Chang Lung Tseng, Changhua (TW)

(73) Assignee: King Yuan Dar Metal Enterprise Co., Ltd., Hsiensi, Changhua (TW)

( * ) Notice: Subject to any disclaimer, the term of this patent is extended or adjusted under 35 U.S.C. 154(b) by 48 days.

(21) Appl. No.: 15/205,084

(22) Filed: Jul. 8, 2016

(65) Prior Publication Data

US 2018/0010856 A1 Jan. 11, 2018

(51) Int. Cl.

| | |
|---|---|
| ***F27B 13/02*** | (2006.01) |
| ***F27B 9/04*** | (2006.01) |
| ***F27D 17/00*** | (2006.01) |
| ***F27B 9/12*** | (2006.01) |

(52) U.S. Cl.

CPC ..... *F27D 17/004* (2013.01); *F27B 9/12* (2013.01); *F27B 2009/122* (2013.01); *F27B 2009/124* (2013.01)

(58) Field of Classification Search

CPC .. F27B 13/02; F27B 9/028; F27B 9/10; F27B 9/04; F27B 9/042; F27B 9/045; C21D 1/767; F24C 15/322

See application file for complete search history.

(56) References Cited

U.S. PATENT DOCUMENTS

| | | | | | |
|---|---|---|---|---|---|
| 1,808,152 | A * | 6/1931 | Baily | C21D 9/46 | 266/252 |
| 2,271,874 | A | 10/1980 | Nugent | | |
| 4,582,301 | A * | 4/1986 | Wunning | F27B 9/3005 | 266/252 |
| 4,715,810 | A * | 12/1987 | Ramsey | C22B 1/005 | 110/222 |
| 4,767,320 | A * | 8/1988 | Sasaki | F27B 9/3005 | 432/152 |
| 5,002,009 | A * | 3/1991 | Hayami | C21D 9/0062 | 118/676 |
| 5,848,890 | A | 12/1998 | McCormick | | |
| 7,520,746 | B1 * | 4/2009 | Johnston | F27B 9/10 | 148/516 |
| 8,298,475 | B2 * | 10/2012 | Tseng | C21D 9/0056 | 266/156 |
| 9,523,136 | B2 * | 12/2016 | Tseng | C21D 9/0056 | |
| 2015/0377552 | A1 * | 12/2015 | Jarmon | F27B 9/028 | 432/11 |

* cited by examiner

*Primary Examiner* — Gregory A Wilson
(74) *Attorney, Agent, or Firm* — Charles E. Baxley

(57) ABSTRACT

A furnace system includes a pre-heating zone disposed on a conveyer device, a furnace facility located behind the pre-heating zone and having a gas heating zone and an electrical heating zone for heating the work piece to the required or predetermined temperature, and a cooling zone for lowering the work piece to a room temperature, the furnace facility includes a heat recycling device connected to the cooling zone and the heating zone, and connected to the pre-heating zone, for collecting a heat energy in the cooling zone and in the heating zone and for supplying the collected heat energy to the pre-heating zone for pre-heating the work piece and for saving the energy.

17 Claims, 5 Drawing Sheets

CONTINUOUS FURNACE SYSTEM HAVING HEAT RECYCLING DEVICE

BACKGROUND OF THE INVENTION

1. Field of the Invention

The present invention relates to a furnace system, and more particularly to a high temperature and continuous furnace system including a pre-heating device for pre-heating the work piece to the required temperature, a furnace facility including a heating zone for heating the work piece to a higher temperature, and a heat recycling mechanism or device for suitably collecting and supplying the collected heat to the pre-heating device and for suitably saving the energy.

2. Description of the Prior Art

Typical steel materials, such as the high chromium steel materials or plates comprise a number of slits or slots or gaps formed or provided therein while subjected with various heating processes or procedures with various kinds of furnace facilities, such that the strengths of the typical high chromium steel materials are low or are not good enough to make products and may become defective products.

For solving such problems, the skilled technicians use or employ a high temperature to heat the typical high chromium steel materials and to have the slits or slots or gaps formed or provided in the typical high chromium steel materials filled with the steel materials and to have a compact and solid structure such that the strengths of the typical high chromium steel materials may be suitably increased and may be used and made into various kinds of products.

For the typical high chromium steel material heating furnaces, the high chromium steel materials or plates are required to be disposed or engaged into the typical steel furnaces for heating the high chromium steel materials or plates to the required higher temperature and for allowing the slits or slots or gaps formed or provided in the typical high chromium steel materials or plates to be filled with the steel materials and to have a compact and solid structure.

U.S. Pat. No. 4,227,874 to Nugent, U.S. Pat. No. 4,582,301 to Wunning, U.S. Pat. No. 4,767,320 to Sasaki et al., U.S. Pat. No. 5,848,890 to McCormick, U.S. Pat. No. 7,520,746 to Johnston et al., and U.S. Pat. No. 8,298,475 to Tseng disclose several of the typical furnace product supporting or transporting devices for supporting or transporting the typical high chromium steel materials or plates into and out of the typical steel furnaces, and a number of heating facilities or devices are required to be provided to suitably heat the steel materials or plates or work pieces to the required higher temperature.

However, the heat energy generated by the heating facilities or devices of the typical furnaces during the heating processes or procedures may not be collected and recycled or reused again, such that the heat energy may not be saved or economized, and such that a number of heat energy will be wasted.

The present invention has arisen to mitigate and/or obviate the afore-described disadvantages of the conventional steel furnace systems.

SUMMARY OF THE INVENTION

The primary objective of the present invention is to provide a high temperature and continuous furnace system including a pre-heating device for pre-heating the work piece to the required temperature, a furnace facility including a heating zone for heating the work piece to a higher temperature, and a heat recycling mechanism or device for suitably collecting and supplying the collected heat to the pre-heating device and for suitably saving the energy.

In accordance with one aspect of the invention, there is provided a furnace system comprising a conveyer device for supporting and transporting a work piece, a pre-heating zone supported on the conveyer device for receiving the work piece and for pre-heating the work piece, a furnace facility including a first heating zone disposed behind the pre-heating zone and separated from the pre-heating zone for heating the work piece, a second heating zone disposed behind the first heating zone for further heating the work piece to a higher temperature, and a cooling zone located behind the second heating zone for lowering the work piece to a room temperature, and a heat recycling device connected to the cooling zone and the first heating zone, and connected to the pre-heating zone, for collecting a heat energy in the cooling zone and in the first heating zone and for supplying the collected heat energy to the pre-heating zone and for pre-heating the work piece and for suitably saving the energy.

The pre-heating zone includes an inlet blowing device connected to the heat recycling device. The pre-heating zone includes an exit door disposed between the pre-heating zone and the first heating zone for suitably separating the pre-heating zone and the first heating zone from each other.

The first heating zone includes an outlet port connected to the heat recycling device. The first heating zone includes a gas heating device disposed in the first heating zone for heating the work piece. The first heating zone includes an exit door disposed between the first heating zone and the second heating zone for suitably separating the first heating zone and the second heating zone from each other.

The second heating zone includes a first section and at least one second section separated from each other with a partition door. The second heating zone includes a fan device, and a motor connected to the fan device for rotating and driving the fan device to circulate an air in order to circulate the heated air in the second heating zone, and for allowing the heated air to be suitably supplied or distributed uniformly within the second heating zone, and thus for allowing the work piece to be suitably and uniformly heated to the required or predetermined higher temperature.

The second heating zone includes an electrical heating device disposed in the second heating zone for heating the work piece to the required or predetermined higher temperature. The second heating zone includes an exit door disposed between the second heating zone and the cooling zone for suitably separating the second heating zone and the cooling zone from each other.

The cooling zone includes a first section and at least one second section separated from each other with a partition door for gradually cooling and reducing the temperature of the work piece. The cooling zone includes an outlet blowing device connected to the heat recycling device.

An inlet vacuuming zone may further be provided and disposed on an entrance zone of the conveyer device and located in front of the pre-heating zone for receiving the work piece and for being vacuumed to retain the work piece within the inlet vacuuming zone. The inlet vacuuming zone includes an exit door disposed between the inlet vacuuming zone and the pre-heating zone. The inlet vacuuming zone includes an entrance door for enclosing the inlet vacuuming zone and for confining the work piece within the inlet vacuuming zone.

An outlet vacuuming zone may further be provided and disposed on an exit zone of the conveyer device and located behind the cooling zone. The cooling zone includes an exit door disposed between the outlet vacuuming zone and the cooling zone. The outlet vacuuming zone includes an exit door directed toward the exit zone of the conveyer device.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
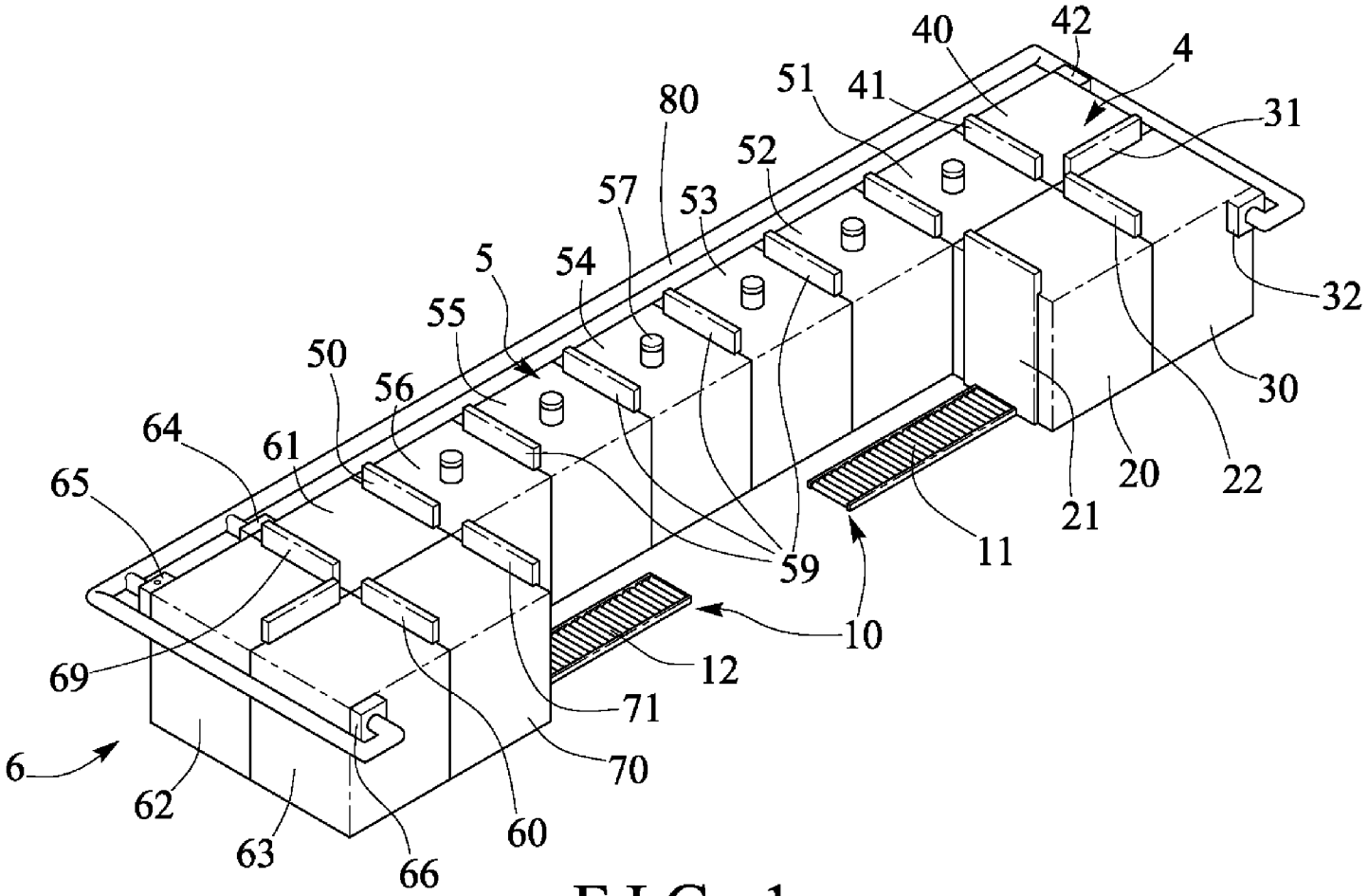
FIG. 1 is a perspective view of a furnace system in accordance with the present invention.
Figure 2:
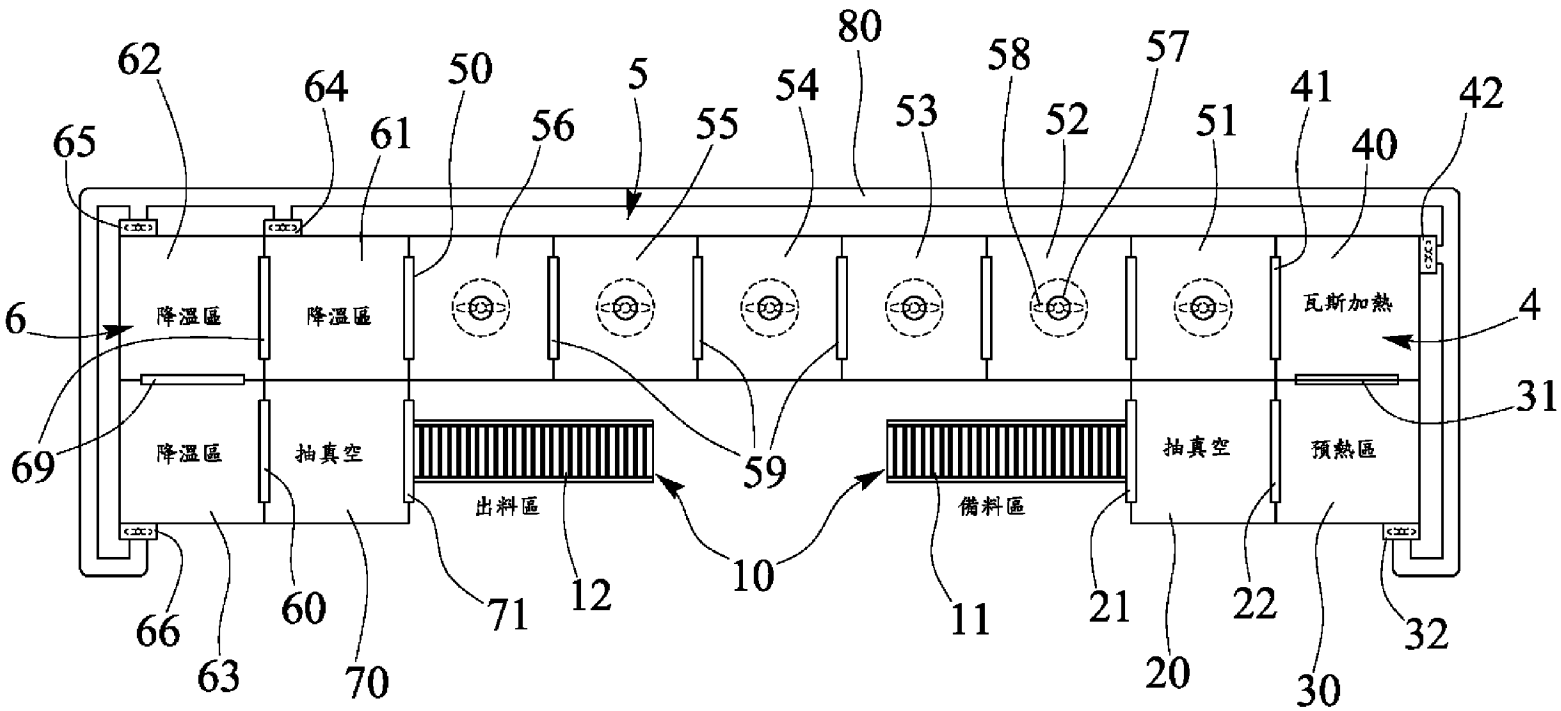
FIG. 2 is a top plan schematic view of the furnace system.
Figure 4:
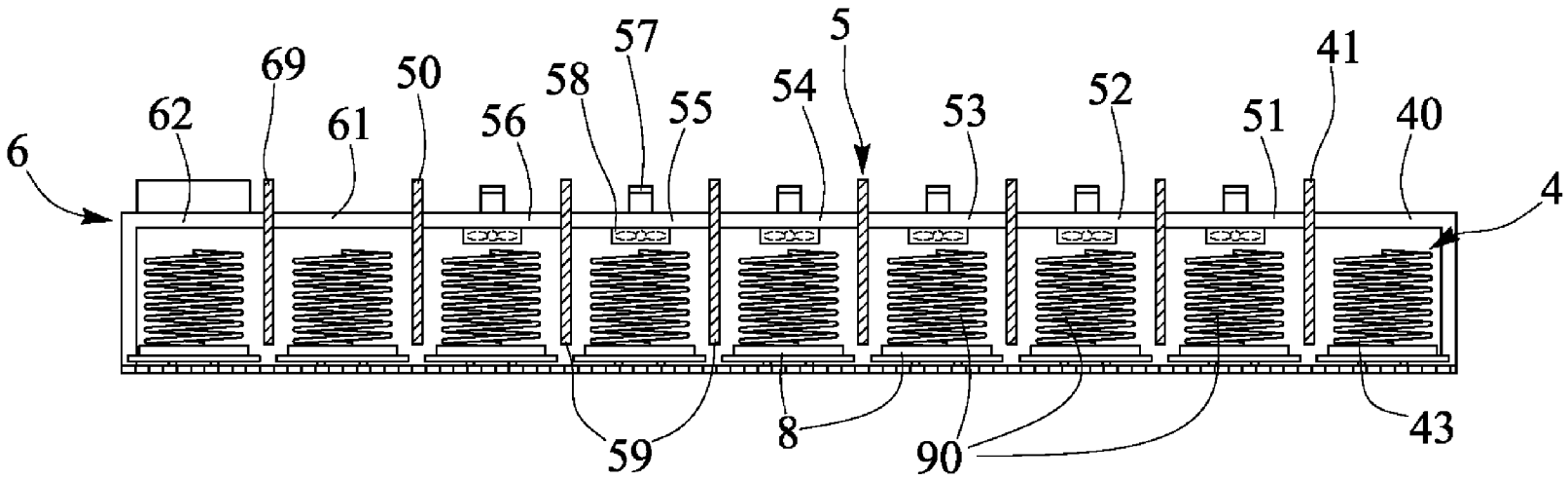
FIG. 4 is a cross sectional view of the furnace system taken along lines 4-4 of FIG. 3.

Referring to the drawings, and initially to FIGS. 1-2, a furnace system in accordance with the present invention comprises a belt or band or roller conveyer device 10 for supporting or transporting the high chromium steel materials or plates or work pieces 90 (FIG. 4) along the conveyer device 10, and the conveyer device 10 includes a front portion or entrance zone 11 for receiving the work piece 90, and a rear portion or exit zone 12 for transporting or moving the work pieces 90 out of the furnace system. An inlet vacuuming zone 20 is disposed or attached or mounted or supported on the conveyer device 10 and arranged or located at or close to the entrance zone 11 of the conveyer device 10 for receiving the work piece 90 and being vacuumed to retain and confine the work piece 90 within the vacuumed inlet vacuuming zone 20. The inlet vacuuming zone 20 includes a front or entrance door 21 and a rear or exit door 22 for selectively enclosing the inlet vacuuming zone 20 and for suitably confining or retaining or positioning the work piece 90 within the vacuumed inlet vacuuming zone 20.

A pre-heating device or zone 30 is also disposed or attached or mounted or supported on the conveyer device 10 and arranged or located close to or beside the inlet vacuuming zone 20, and for gradually pre-heating the work piece 90 to the required or predetermined temperature (about 0~200° C.)., for example, the pre-heating zone 30 is disposed or supported beside the exit door 22 of the inlet vacuuming zone 20 which may control the work piece 90 to move from the inlet vacuuming zone 20 to the pre-heating zone 30, the pre-heating zone 30 further includes a rear or exit door 31 for selectively enclosing the pre-heating zone 30 and for suitably confining or retaining or positioning the work piece 90 within the pre-heating zone 30. The pre-heating zone 30 further includes an inlet blowing device 32 attached or coupled thereto for drawing and supplying the collected heat into the pre-heating zone 30.

A furnace facility 4 is also disposed or attached or mounted or supported on top of the conveyer device 10 and disposed or arranged or located behind and/or beside the pre-heating zone 30 and/or the inlet vacuuming zone 20, and includes a gas or first heating zone 40 of gaseous heating devices or materials disposed or located or arranged behind or beside the pre-heating zone 30 and separated from the pre-heating zone 30 with the exit door 31 for further heating and increasing the temperature of the work piece 90 to the required or predetermined higher temperature (about 500° C.), the gas or first heating zone 40 includes a rear or exit door 41 for selectively enclosing the gas or first heating zone 40 and for suitably confining or retaining or positioning the work piece 90 within the first heating zone 40. The first heating zone 40 includes an outlet port 42 for allowing the heat energy generated in the first heating zone 40 to selectively flow out through the outlet port 42, and includes a gas heating member or device 43 (FIG. 4) disposed or engaged in the first heating zone 40 for heating the work piece 90 to the required or predetermined temperature (about 500° C.).

The furnace facility 4 further includes an electrical or second heating zone 5 of electrical heating devices or materials disposed or located or arranged behind or beside the first heating zone 40 and/or the inlet vacuuming zone 20, and separated from the first heating zone 40 with the exit door 41 for further heating and increasing the temperature of the work piece 90 to the required or predetermined higher temperature (about 750-780° C.)., the electrical or second heating zone 5 includes a rear or exit door 50 for selectively enclosing the electrical or second heating zone 5 and for suitably confining or retaining or positioning the work piece 90 within the electrical or second heating zone 5. The electrical or second heating zone 5 may be spaced or separated or divided into two or more (such as six) segments or sections 51, 52, 53, 54, 55, 56, and includes two or more middle or intermediate or partition doors 59 for selectively enclosing and separating the sections 51-56 of the electrical or second heating zone 5 from each other and for suitably confining or retaining or positioning the work piece 90 within the sections 51-56 of the electrical or second heating zone 5.

The electrical or second heating zone 5 includes a motor 57 and a fan device 58 disposed or engaged in each of the sections 51-56 of the electrical or second heating zone 5, and the fan devices 58 is connected or coupled to the motor 57 and may be rotated or driven by the motor 57 in order to suitably circulate the heated air in the sections 51-56 of the electrical or second heating zone 5, and for allowing the heated air to be suitably supplied or distributed uniformly within the sections 51-56 of the electrical or second heating zone 5, and thus for allowing the work piece 90 to be suitably and uniformly heated to the required or predetermined higher temperature (about 750-780° C.).

The furnace facility 4 further includes an ageing or temperature decreasing zone or cooling zone 6 disposed or located or arranged behind or beside the electrical or second heating zone 50 for gradually lowering or decreasing the temperature of the work piece 90 to the required or predetermined less or lower temperature (about 730~200° C.), and separated from the sixth section 56 of the electrical or second heating zone 50 with the exit door 50 for decreasing the temperature of the work piece 90 to the required or predetermined lower temperature (about 730-200° C.), the cooling zone 6 includes a rear or exit door 60 for selectively enclosing the cooling zone 6 and for suitably confining or retaining or positioning the work piece 90 within the cooling zone 6. The cooling zone 6 may be spaced or separated or divided into two or more (such as three) segments or sections 61, 62, 63, and includes two or more partition doors 69 for selectively enclosing and separating the sections 61-63 of the cooling zone 6 from each other and for suitably confining or retaining or positioning the work piece 90 within the sections 61-63 of the cooling zone 6.

The cooling zone 6 further includes an outlet blowing device 64, 65, 66 attached or coupled to each of the sections 61-63 of the cooling zone 6 for drawing and supplying the heat within the sections 61-63 of the cooling zone 6 out of the cooling zone 6 of the furnace facility 4. The furnace system in accordance with the present invention further includes an outlet vacuuming zone 70 disposed or attached or mounted or supported on the conveyer device 10 and arranged or located behind or beside the first section 61 and the third section 63 of the cooling zone 6, and separated from the third section 63 of the cooling zone 6 with the exit door 60. The outlet vacuuming zone 70 is arranged or located between the third section 63 of the cooling zone 6 and the rear portion or exit zone 12 of the conveyer device 10 for receiving the work piece 90 from the cooling zone 6, and the outlet vacuuming zone 70 includes an exit door 71 directed or faced toward the rear portion or exit zone 12 of the conveyer device 10, and is vacuumed to retain and confine the work piece 90 within the vacuumed outlet vacuuming zone 70.

Figure 3:
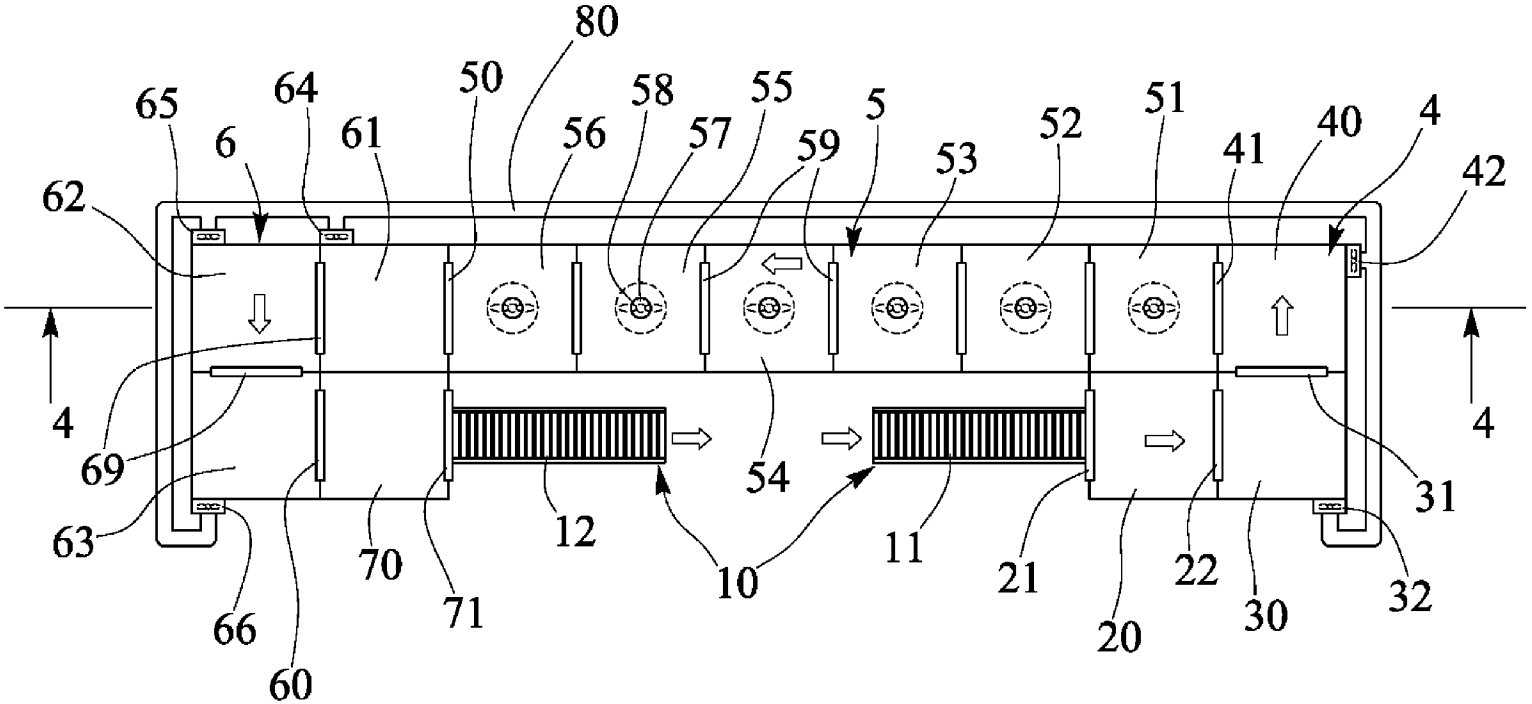
FIG. 3 is another top plan schematic view similar to FIG. 2, illustrating the operation of the furnace system.
Figure 5:
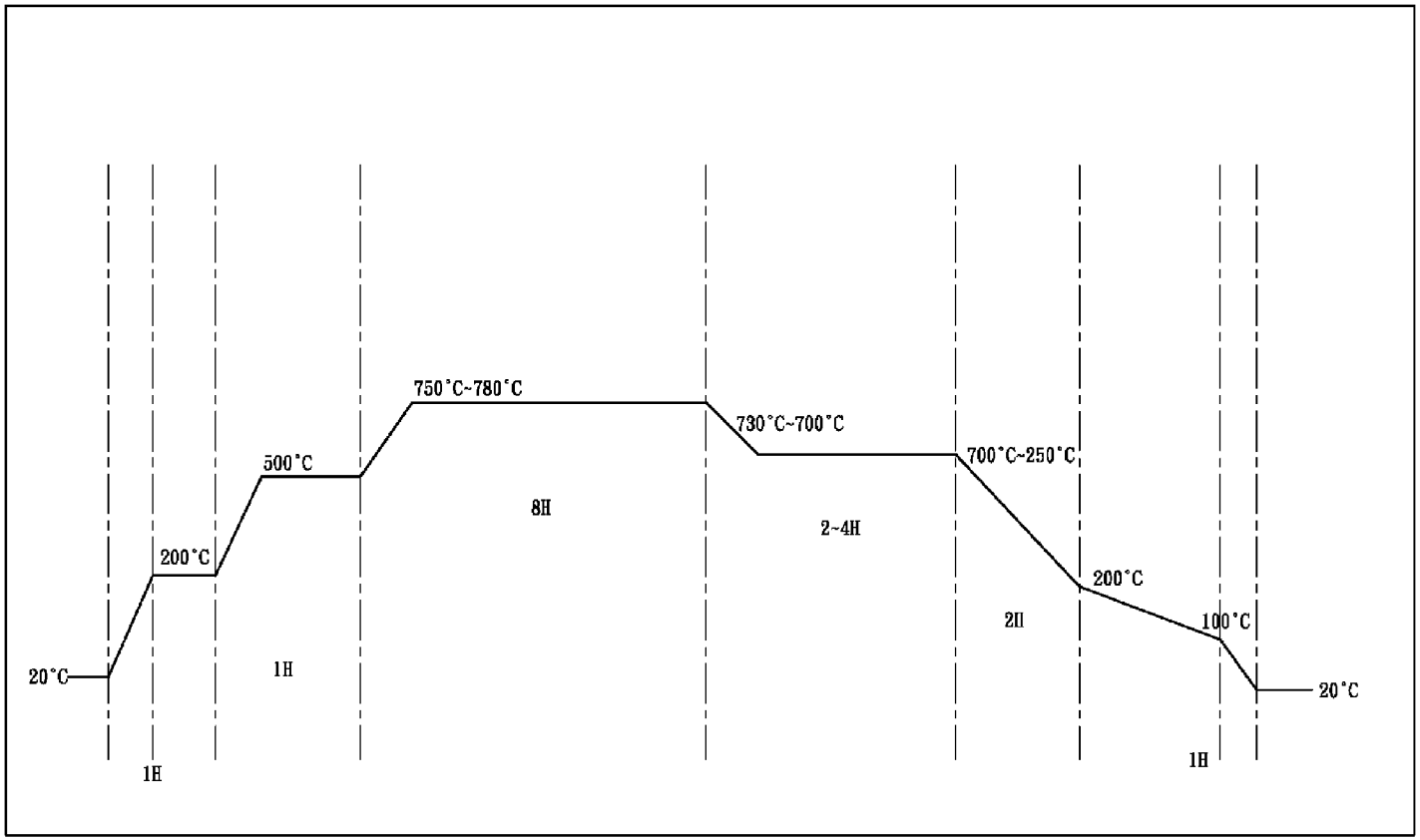
FIG. 5 is a block diagram illustrating the operation of the furnace system.

In operation, as shown in FIG. 3, the work piece 90 will be disposed or supported on the entrance zone 11 of the conveyer device 10 and will be gradually transported or moved or sent into the inlet vacuuming zone 20, the pre-heating zone 30, the gas or first heating zone 40, the sections 51-56 of the electrical or second heating zone 50, and then to the sections 61-63 of the cooling zone 6, and then to the outlet vacuuming zone 70, and then to the rear portion or exit zone 12 of the conveyer device 10. As shown in FIG. 5, the work piece 90 will be gradually pre-heated from 20° C. to about 200° C. in about one hour, and maintained at 200° C. for about one hour, and then gradually heated from 200° C. to about 500° C. in about one hour, and maintained at 500° C. for about one hour, and then heated again from 500° C. to about 750-780° C. and maintained at about 750-780° C. for about eight hours, and then cooled from about 750-780° C. to about 730-700° C. and maintained at about 730-700° C. for about two to four hours, and then cooled again from 700° C. to about 200° C. in about two hours, and then cooled again from 200° C. to about 100° C. in about one hour, and then cooled again from 100° C. to the required or predetermined less or lower or room temperature (about 20° C.).

The furnace system in accordance with the present invention further includes a heat recycling mechanism or tube or device 80 connected or coupled to the outlet blowing devices 64-66 of the cooling zone 6, and/or connected or coupled to the outlet port 42 of the first heating zone 40, and connected or coupled to the inlet blowing device 32 of the pre-heating zone 30, for suitably collecting the heat energy within the sections 61-63 of the cooling zone 6 and/or in the sections 51-56 of the electrical or second heating zone 50, and/or in the first heating zone 40, and then for suitably feeding or supplying the collected heat energy to the pre-heating zone 30 to pre-heat the work piece and for suitably recycling or economizing or saving the energy.

Accordingly, the high temperature and continuous furnace system in accordance with the present invention includes a pre-heating zone for pre-heating the work piece to the required temperature, a furnace facility including a heating zone for heating the work piece to a higher temperature, and a heat recycling mechanism or device for suitably collecting and supplying the collected heat to the pre-heating zone and for suitably saving the energy.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A furnace system comprising:
- a conveyer device for supporting and transporting a work piece,
- a pre-heating zone supported on said conveyer device for receiving said work piece and for pre-heating said work piece,
- a furnace facility including:
- a first heating zone disposed behind said pre-heating zone and separated from said pre-heating zone for heating said work piece,
- a second heating zone disposed behind said first heating zone for further heating said work piece to a higher temperature, and
- a cooling zone located behind said second heating zone for lowering said work piece to a room temperature,
- a heat recycling device connected to said cooling zone and said first heating zone, and connected to said pre-heating zone, for collecting a heat energy in said cooling zone and in said first heating zone and for supplying said collected heat energy to said pre-heating zone for pre-heating said work piece, and
- an inlet vacuuming zone disposed on an entrance zone of said conveyer device and located in front of said pre-heating zone for receiving said work piece and for being vacuumed to retain said work piece within said inlet vacuuming zone.

2. The furnace system as claimed in claim 1, wherein said pre-heating zone includes an inlet blowing device connected to said heat recycling device.

3. The furnace system as claimed in claim 1, wherein said pre-heating zone includes an exit door disposed between said pre-heating zone and said first heating zone.

4. The furnace system as claimed in claim 1, wherein said first heating zone includes an outlet port connected to said heat recycling device.

5. The furnace system as claimed in claim 1, wherein said first heating zone includes a gas heating device disposed in said first heating zone for heating said work piece.

6. The furnace system as claimed in claim 1, wherein said first heating zone includes an exit door disposed between said first heating zone and said second heating zone.

7. The furnace system as claimed in claim 1, wherein said second heating zone includes a first section and at least one second section separated from each other with a partition door.

8. The furnace system as claimed in claim 1, wherein said second heating zone includes a fan device, and a motor connected to said fan device for rotating and driving said fan device to circulate an air.

9. The furnace system as claimed in claim 1, wherein said second heating zone includes an electrical heating device disposed in said second heating zone for heating said work piece.

10. The furnace system as claimed in claim 1, wherein said second heating zone includes an exit door disposed between said second heating zone and said cooling zone.

11. The furnace system as claimed in claim 1, wherein said cooling zone includes a first section and at least one second section separated from each other with a partition door.

12. The furnace system as claimed in claim 1, wherein said cooling zone includes an outlet blowing device connected to said heat recycling device.

13. The furnace system as claimed in claim 1, wherein said inlet vacuuming zone includes an exit door disposed between said inlet vacuuming zone and said pre-heating zone.

14. The furnace system as claimed in claim 1, wherein said inlet vacuuming zone includes an entrance door for enclosing said inlet vacuuming zone and for confining said work piece within said inlet vacuuming zone.

15. A furnace system comprising:

a conveyer device for supporting and transporting a work piece, a pre-heating zone supported on said conveyer device for receiving said work piece and for pre-heating said work piece, a furnace facility including:

a first heating zone disposed behind said pre-heating zone and separated from said pre-heating zone for heating said work piece, a second heating zone disposed behind said first heating zone for further heating said work piece to a higher temperature, and a cooling zone located behind said second heating zone for lowering said work piece to a room temperature, a heat recycling device connected to said cooling zone and said first heating zone, and connected to said pre-heating zone, for collecting a heat energy in said cooling zone and in said first heating zone and for supplying said collected heat energy to said pre-heating zone for pre-heating said work piece, and an outlet vacuuming zone disposed on an exit zone of said conveyer device and located behind said cooling zone.

16. The furnace system as claimed in claim 15, wherein said cooling zone includes an exit door disposed between said outlet vacuuming zone and said cooling zone.

17. The furnace system as claimed in claim 15, wherein said outlet vacuuming zone includes an exit door directed toward said exit zone of said conveyer device.

* * * * *